United States Patent [19]

Mahon et al.

[11] Patent Number: 4,945,196

[45] **Date of Patent: * Jul. 31, 1990**

[54] PROVIDING A PROGRAMMER/TIMER WITH DUAL RATE DRIVE

[75] Inventors: Joseph J. Mahon, Libertyville; Robert K. Aigner, Chicago, both of Ill.

[73] Assignee: Eaton Corporation

[ * ] Notice: The portion of the term of this patent subsequent to Aug. 8, 2006 has been disclaimed.

[21] Appl. No.: 386,163

[22] Filed: Jul. 28, 1989

Related U.S. Application Data

[63] Continuation of Ser. No. 242,397, Sep. 9, 1988, Pat. No. 4,856,096.

[51] Int. Cl.[5] ..... H01H 7/08

[52] U.S. Cl. ..... 200/38 C; 74/568 T; 200/38 A

[58] Field of Search ..... 200/35 R, 38 R, 38 A, 200/38 F, 38 FA, 38 FB, 38 B, 38 BA, 38 C, 38 CA; 74/568 T

[56] References Cited

U.S. PATENT DOCUMENTS

| | | | |
|---|---|---|---|
| 4,366,352 | 12/1982 | Obermann | 200/35 R |
| 4,611,103 | 9/1986 | Eder et al. | 200/38 B |
| 4,856,096 | 8/1989 | Mahon et al. | 200/38 C |

*Primary Examiner*—J. R. Scott

*Attorney, Agent, or Firm*—R. A. Johnston

[57] ABSTRACT

A programmer/timer for an appliance of the type having a rotatable cam drum advanced for sequential actuation and deactuation of a plurality of electrical switches. The drum is advanced or indexed intermittently by an oscillating advance pawl engaging a ratchet wheel and also continuously by a gear driven by a common motor for oscillating the advance pawl. The ratchet wheel has a hub which is frictionally engaged to drive the cam drum. The driven gear in turn is frictionally engaged with the hub to also drive the ratchet wheel. When the advance pawl engages the ratchet wheel for intermittent drive, the driven gear slips on the ratchet hub. Upon user selection, a separate cam track lifts the advance pawl to permit the driven gear to continuously drive the ratchet wheel.

9 Claims, 1 Drawing Sheet

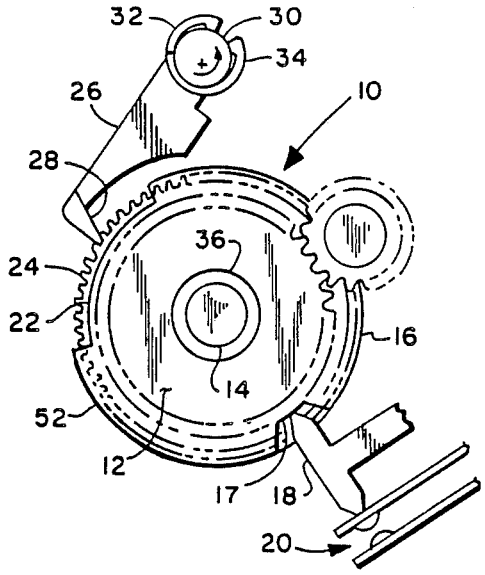

PROVIDING A PROGRAMMER/TIMER WITH DUAL RATE DRIVE

This application is a continuation of application Ser. No. 242,397 filed Sept. 9, 1988, now U.S. Pat. No. 4,856,096.

BACKGROUND OF THE INVENTION

The present invention relates to electromechanical programmer/timers utilized for sequentially activating at least one and usually a plurality of electrical switches for a selective program interval. Programmer/timers of this sort are commonly employed for appliances such as clothes washing machines, dishwashers, microwave ovens and other appliances wherein it is desired for the machine user to select a desired program interval for the appliance operation; and, upon such selection a timing motor provides advancement of a cam track for sequentially actuating the machine control function switches during time-out of the selected interval.

Typically, electromechanical appliance programmer/timers utilize a subfractional horsepower synchronous timer motor driving either a continuous drive to the cam through a speed reducer, or employ an indexing mechanism such as a ratchet wheel engaged by a periodically advanced and retracted pawl.

Heretofore, differing rates of advance in appliance programmer/timers have been provided by utilizing ratchet teeth of varying depth disposed about the advance ratchet with blocking means, usually comprising a masking ratchet wheel, to permit the pawl to engage the notches of greatest depth only upon selected multiples of the advanced pawl stroke, thus providing alternate rates of intermittent advancement of the cam ratchet. However, the fastest rate of advancement in such arrangements is determined by the number of teeth having the greatest minor diameter on the ratchet wheel with the teeth of lesser major diameter providing a substantially slower rate of advancement. Where continuous drive for the cam is employed via means of a motor speed reducer, it has heretofore been the practice to shift or change gearing in order to provide alternate rate of advance.

However, in certain appliance applications, it is desired to provide a relatively slow rate of advancement utilizing the well known ratchet and pawl cam indexing technique; however, it is also desired to provide a substantially more rapid rate of advancement of the cam for certain selected portions of the program time out interval. Therefor, utilizing only a ratchet and pawl advance technique for the cam track limits the resolution of the cam track by virtue of the pitch of the teeth required to provide the desired maximum rate of advance. If the pitch of the teeth for the ratchet is chosen for the desired maximum rate of advance, within the allowable diameter for the ratchet, problems have been encountered in providing the desired resolution of the cam functions within a single revolution of the rotary cam track.

Therefore, it has long been desired to provide an electromechanical programmer/timer for appliance having a ratchet and pawl advance mechanism providing a relatively fast rate of advance and yet also provide for a substantially slower rate of advance with a continuous drive means for a portion of the selected program interval.

SUMMARY OF THE INVENTION

The present invention provides an electromechanical programmer/timer for appliances having a relatively fast rate of advance of the switch cam track provided by an oscillating advance pawl and ratchet wheel and a substantially slower rate of advance provided by a continuous speed reducer drive. The ratchet is connected to drive the cam track by a first frictional clutch means and the continuous drive is connected for driving the ratchet by a second frictional clutch means which is permitted to slip when the pawl is engaged for advancing the ratchet. The cam track has a portion thereof configured to lift the advanced pawl from the ratchet, thereby disabling the pawl and ratchet advance, whereupon the second frictional clutch ceases to slip and the continuous drive provides for the slower rate of advance.

User selection of the desired program interval for the cam track is accomplished by user rotation of the cam track which is permitted by slippage of the first and second clutch means to enable the desired positioning of the cam track for commencement of the timed interval for the program.

In the preferred form, the first clutch means comprises a frictional engagement between the interior of the hub on the ratchet wheel and a shaft connected to the cam track. A second clutch means comprises a collet provided on the speed reducer gear with the collet frictionally engaging the exterior of the ratchet wheel head.

The present invention thus provides a novel and simplified instruction for a programmer/timer for appliances wherein a single drive motor is operative to providing a fast rate of advancement through a pawl advancing a ratchet wheel and a slower rate through continuous drive to the ratchet wheel which slips during pawl advancement of the ratchet. Upon lifting of the ratchet, the slipping clutch ceases to slip and provides a slower rate of continuous drive to the cam track.

DETAILED DESCRIPTION

Figure 1:
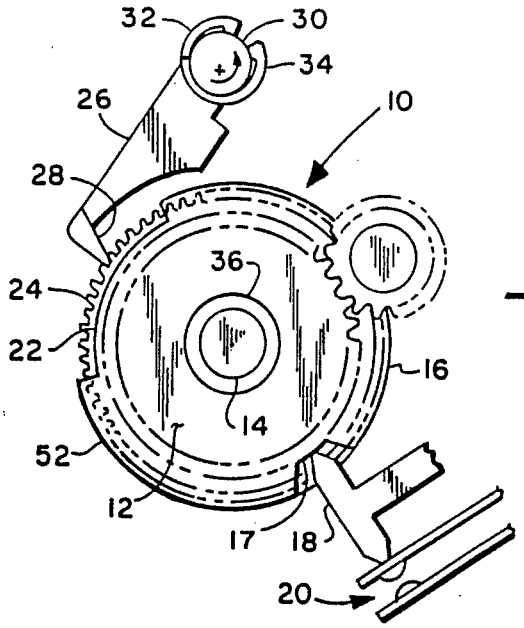
FIG. 1 is a pictorial representation of the cam track ratchet advance pawl and gear train for the programmer/timer of the present invention with the advance pawl engaging the ratchet.

Referring to FIG. 1, the dual rate drive mechanism for a programmer/timer is illustrated generally by reference numeral 10 and comprises a drum 12 mounted for rotation about shaft 14 and having a cam track 16 provided about the periphery thereof. A cam follower means 18 is pivotally exposed on the base or housing means (not shown) and the follower is engaged in track 16 and is operative to effect actuation and deactuation of the electrical switch mechanism indicated generally at 20. In the illustration of FIG. 1, the cam drum 12 is shown rotated to a position such that the cam follower 18 rests against the depressed or base circle portion 17 of cam track 16 and in this position effects deactuation or opening of the switch 20.

The portion of cam track 16 on drum 12 disposed generally diameterally opposite the depressed portion 17 is also depressed for a desired arcuate segment of the cam track periphery as indicated by the reference numeral 22. A toothed ratchet wheel having teeth 24 of substantially constant pitch and root diameter greater than tracks 22 are formed about the periphery thereof; and, the ratchet 25 is disposed concentrically with respect to shaft 14 and in axially spaced relationship with cam drum 12.

An advance pawl 26 is provided and has a chisel point 28 disposed to engage the ratchet teeth 24 as illustrated in FIG. 1. Pawl 26 is connected to orbiting concentric crank pin 30 and has the end thereof opposite to the point 28 disposed over pin 30 and biased thereon by integrally formed spring fingers 34, 32. It will be understood that the crank pin 30 is rotated by a speed reducer and motor drive mechanism (not shown).

Figure 3:
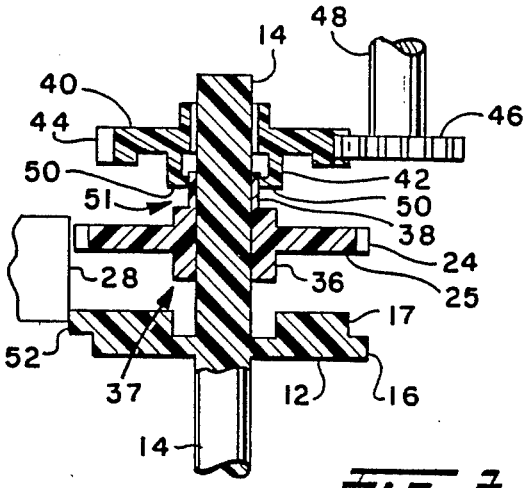

Referring to FIGS. 1 and 3, the cam drum 12 is illustrated in the preferred practice as being integrally formed on shaft 14 and is rotated therewith by user rotation of the shaft 14 for positioning the cam track 16 at a desired rotational position with respect to cam follower 18. Ratchet wheel 25 is shown in FIG. 3 as having an axially extending hub 36 which has the inner periphery thereof received over shaft 14 so as to position the ratchet teeth 24 in alignment for engagement with the pawl chisel point 28. The ratchet hub engages the shaft 14 in a frictional engagement and comprises a first frictional clutching means indicated generally by the numeral 37 for operatively connecting the ratchet wheel 25 for rotationally driving cam drum 12. The ratchet hub 36 has a reduced diameter extension portion 38 extending from the hub in a direction opposite that of the cam drum 12.

A speed reducing gear 40 has a central hub 42 provided thereon and received over shaft 14 adjacent the reduced diameter portion 38 of the ratchet hub. Gear 40 has peripheral teeth 44 continuously engaged by a motor drive pinion gear 46 which is driven from shaft 48 by a motor (not shown). It will be understood, however, that a common motor drive may be employed with appropriate speed reduction for the eccentric shaft 30 and for the pinion gear 46.

The hub 42 of gear 40 has provided on the interior thereof a plurality of collet jaws 50 which frictionally engage the exterior of the smaller hub diameter 38 in frictional engagement and comprise a second clutching means indicated generally by reference numeral 51 in FIG. 3 for providing a continuous drive from shaft 48 to ratchet wheel 25 via gear 44 and through the first clutching means 37 to the cam drum 12.

Figure 2:
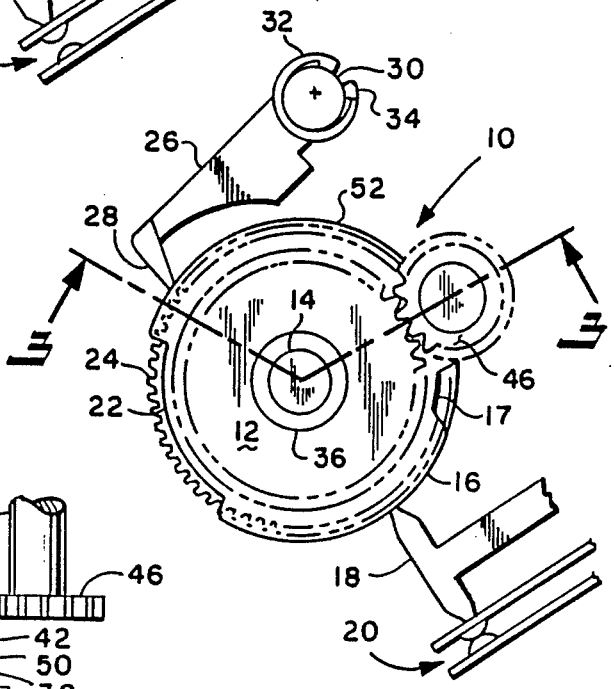
FIG. 2 is a view similar to FIG. 1 showing the advanced pawl lifted from the ratchet by a blocking track on the cam; and, FIG. 3 is a section view taken along broken section line 3—3 of FIG. 1.

Referring to FIG. 2, the drive of FIG. 1 is shown with the cam drum 12 rotated to a position where a second cam track 52 has raised the chisel point 28 an amount sufficient to disengage the pawl from the ratchet teeth 24. This lifted position is shown in greater detail in FIG. 3.

In operation, when the cam drum 12 is positioned such that track 22 permits the ratchet teeth 24 to be engaged by the pawl chisel point 28, the cam drum 12 is driven by the first frictional clutch 37; and, the second frictional clutch 51 permits shaft 14 to be overdriven by slippage therein.

In operation, during the initial portion of the selected program the ratchet wheel 25 is advanced by clutch 51 engaging hub 36 with the pawl chisel point 28 lifted from the ratchet teeth 24 by cam track 52. Upon reaching the end of track 52, point 28 engages ratchet teeth 24, driving of the ratchet wheel 25 so long as the pawl tooth 28 is permitted to contact teeth 24. Thereafter, the clutch means 51 begins slipping the shaft 14 is driven by clutch 37 at the speed of rotation of the gear 25. The drum 12 continues rotating until the cam track 16 reaches the recessed cam track portion 17 whereupon cam follower drops and deactuates or opens switch 20 to cut line power to the motor drive (not shown) for shaft 48.

In the presently preferred practice of the invention, the pawl and ratchet drive is operable to provide a faster rotation to cam drive 12 than the continuously rotating pinion gear 46 driving through gear 40 and clutch 51. In one application of the invention, it has been found desirable to rotate the eccentric shaft 30 at a rate of 4 revolutions per minute (4 RPM) thereby giving the pawl 26 a period of oscillation of 15 seconds. Concomitantly, the driving pinion 46 is rotated at a rate of one-fifteenth revolution Per minute (1/15 RPM); and, the ratio of the number of teeth on pinion 46 to the number of gear teeth 44 is 1:4 giving the gear 40 a rate of rotation of one-sixtieth revolution per minute (1/60 RPM).

In the present practice of the invention, in one application, it has been found satisfactory to have clutch 51 provided with a slippage or break-away torque of forty (40) in-ounces; and, the clutch 37 has a break-away torque of 20 in-ounces.

When the motor drive (not shown) for driving eccentric shaft 30 and pinion 46 is inoperative e.g. switch 20 is open, shaft 14 may be rotated by the appliance user in either direction. If the pawl 26 is in the position shown in FIG. 2, clutch 37 will slip to permit positioning of the cam in either direction. If the pawl is in the position shown in FIG. 1, with the chisel point engaging the ratchet teeth, clutch 37 will slip upon user rotation of shaft 14.

The present invention provides unique and novel dual rate drive for an electromechanical programmer/-timer for actuating appliance function switches in a sequence during a selected program interval. The programmer/timer of the present invention provides a pawl and ratchet drive to a rotatable switch cam drum in which the ratchet wheel is frictionally clutched to the cam drum shaft; and, the ratchet wheel hub is also separately frictionally clutched to a continuously rotating motor drive gear. Upon engagement of the pawl with the ratchet, the friction clutch to the continuously driven gear slips and permits the shaft to be overdriven. Upon the cam drum rotating to a desired position, a cam track lifts the pawl from engagement with the advance ratchet and the shaft is not overdriven and slippage of the gear clutch ceases and the cam drum shaft is driven at a slower rate by the continuously rotated drive gear. Upon time-down to the lower cam position, the pawl engages the ratchet and the drum overdrives the continuously driven gear. The user positioning of the cam drum is accomplished by permitting clutch 37 to slip upon user rotation of the cam drum shaft in either direction.

The present invention has been hereinabove described and illustrated in the drawings in the presently preferred practice. However, it will be understood that modifications and variations may be made to the disclosed version and the invention is limited only by the scope of the following claims.

We claim:

1. A dual rate time-out electromechanical programmer for an appliance comprising:

(a) housing means;

(b) program means including shaft means mounted for rotation on said housing means and having at least one program track thereon;

(c) at least one appliance program function switch having a cam follower means responsive to said cam track for opening and closing said switch;

(d) first advance means operative upon receipt of power to drive said program cam means through a first frictional coupling and including a toothed member rotatably connected with said program cam means and a first driving means movably disposed on said housing means for movement between a first position drivingly engaging said toothed member and a second position drivingly disengaged from said toothed member;

(e) blocking means operative in response to user rotation of said shaft means and program cam means to a selected position, to move said first driving means to said second disengaged position;

(f) second advance means operative upon receipt of power, to continuously drive said program cam means through a second rotary frictional coupling, said second advance means operable to advance said program cam means at a rate significantly different from the rate of said first advance means;

(g) wherein said first advance means is operative to override said second rotary frictional coupling when said first driving means is in said first position.

2. The programmer defined in claim 1, wherein said second frictional coupling drives through said first frictional coupling.

3. The programmer defined in claim 1, wherein said second rotary frictional coupling has a higher frequency torque than said first rotary frictional coupling.

4. The programmer defined in claim 1, wherein said first driving means comprises an oscillating drive pawl having the end thereof engaging said toothed member in said second position.

5. The programmer defined in claim 1, wherein the rate of advance of said first advance means is significantly faster than that of said second advance means.

6. The programmer defined in claim 1, wherein said blocking means includes an auxiliary cam track on said program cam means.

7. A method of providing an electromechanical appliance programmer with a dual rate of time-out comprising the steps of:

(a) providing a rotatable cam for actuating at least one switch and frictionally coupling a toothed member to said cam;

(b) providing a first motorized advance means and engaging said toothed member and advancing said cam at a first rate through a frictional coupling;

(c) frictionally engaging said toothed member with a continuous motor drive and allowing said motor drive to slip during said first rate of advance;

(d) disengaging said first advance means from said toothed member and advancing said cam at a second rate through said continuous motor drive.

8. The method defined in claim 7, wherein said step of frictionally engaging said toothed member with a continuous motor drive includes the steps of providing a hub on said toothed member and frictionally engaging said hub with a collet.

9. The method defined in claim 7, wherein the step of providing a first motorized advance means includes the steps of providing an oscillating pawl and engaging said toothed member with said pawl.

* * * * *